United States Patent [19]

Caldwell

[11] 4,278,214

[45] Jul. 14, 1981

[54] PORTABLE ELECTRIC WIRE REEL

[76] Inventor: Benton B. Caldwell, 405 Circle Dr., Fredrick, Okla. 73542

[21] Appl. No.: 74,630

[22] Filed: Sep. 12, 1979

[51] Int. Cl.[3] ..... B65H 75/40

[52] U.S. Cl. ..... 242/106; 242/86.5 R

[58] Field of Search ..... 242/86.5 R, 86.5 A, 242/86.51, 86.52, 86.7, 86.8, 99, 106, 85, 86, 86.2, 129.5; 254/323, 359, 380

[56] References Cited

U.S. PATENT DOCUMENTS

| | | | |
|---|---|---|---|
| 557,752 | 4/1896 | Arnold | 242/99 |
| 585,059 | 6/1897 | Sylvester | 242/86.5 R X |
| 3,070,324 | 12/1962 | Bryman | 242/86.5 R |
| 3,106,358 | 10/1963 | Lehmann | 242/85 X |
| 3,910,524 | 10/1975 | Ireland | 242/106 |
| 3,946,991 | 3/1976 | Eriksson | 242/86.5 R X |
| 4,190,211 | 2/1980 | Janzen | 242/86.5 R X |

*Primary Examiner*—John M. Jillions
*Attorney, Agent, or Firm*—Robert K. Rhea

[57] ABSTRACT

A telescopically adjustable base supports an upright frame horizontally journalling a shaft having a driven pulley on one end portion and a wire reel on its other end portion. A pair of arms, pivotally connected with the upright frame, supports an electric motor having a drive pulley for gravity tension of a belt entrained around the pulleys.

8 Claims, 5 Drawing Figures

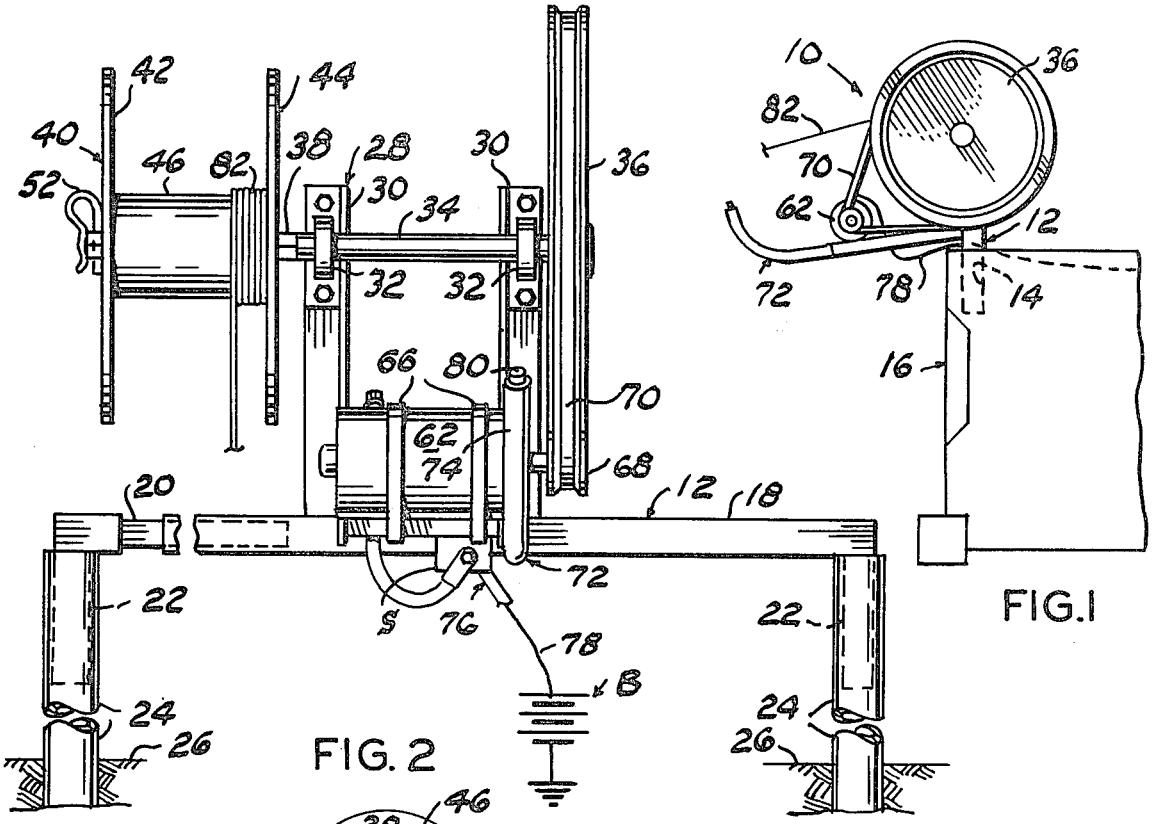
FIG. 2
FIG. 1
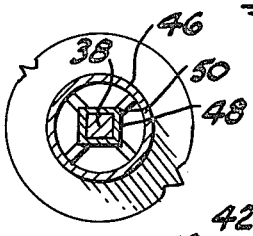
FIG. 5
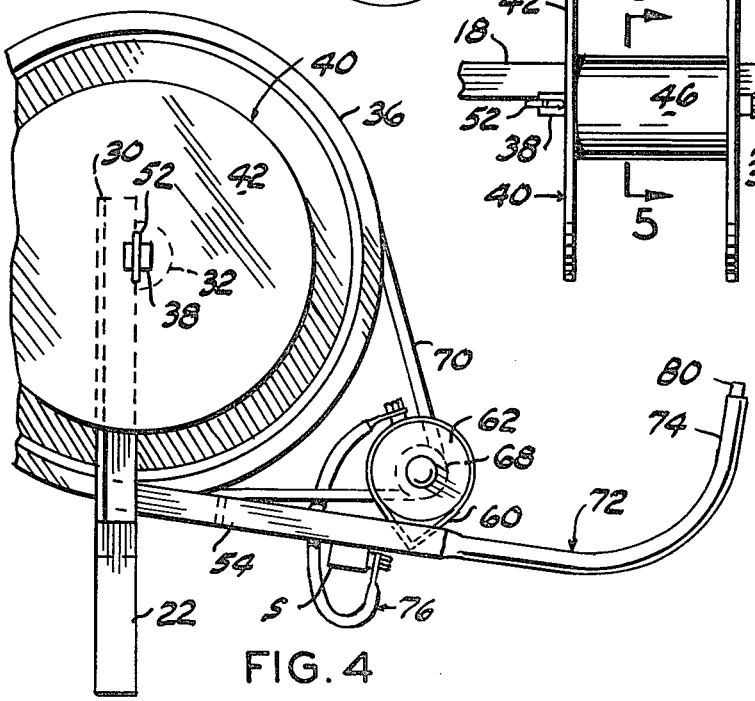
FIG. 4
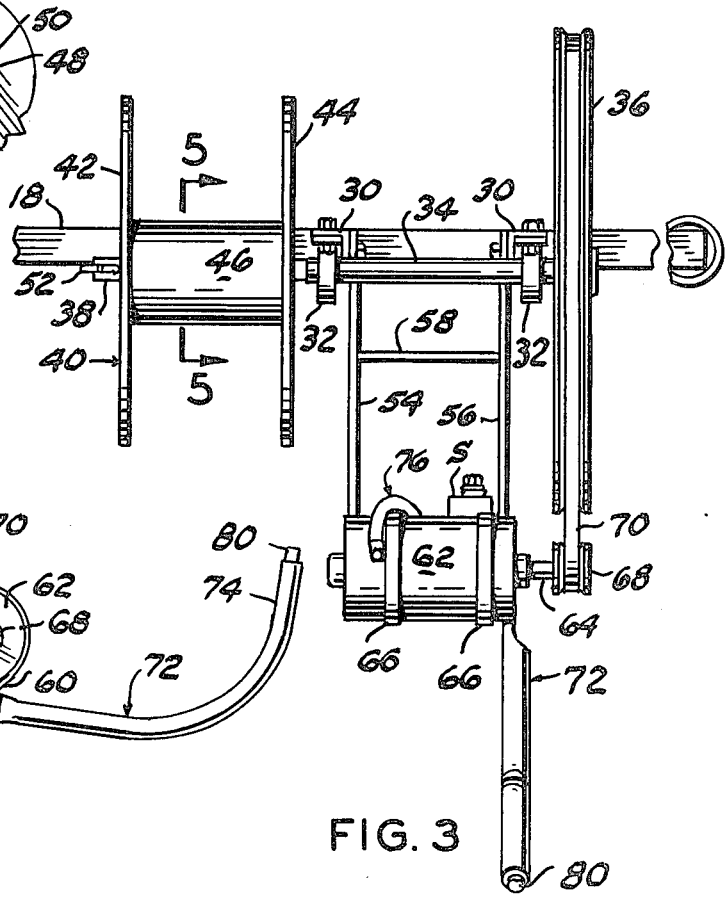
FIG. 3

PORTABLE ELECTRIC WIRE REEL

BACKGROUND OF THE INVENTION

1. Field of the Invention

The present invention relates to wire reels and more particularly to a portable motor driven wire reel for winding up and paying out electric fence wire, or the like.

Farmers-ranchers seasonally erect electric wire fences to maintain cattle or other livestock on selected areas of wheat to be grazed. These electric fences must be dismantled and removed at the time the cattle are removed from the wheat fields for allowing the wheat to mature.

This invention provides a reeling device for quickly reeling and storing the wire until it is to be reused.

2. Description of the Prior Art

Wire reel prior patents generally relate to wheel supported mobile frames capable of winding up or paying out fence wire, or the like, and to apparatus for supporting a spool of wire to be payed out while supported by a vehicle while stationary or traversing the surface of the earth. Other wire or strand reeling patents disclose apparatus mounted on a boat for releasing or retrieving a ski rope.

The most pertinent prior patent is U.S. Pat. No. 3,070,324 which discloses a wire reeling device mounted on a vehicle in which a friction disk clutch connected with the vehicle transmission forms an infinitely variable transmission to permit manual control of the angular rotation of the wire reel with respect to movement of the vehicle. This patent also discloses a pivotally mounted motor driving the wire reel by a belt with belt tension maintained by a spring maintaining constant downward pulling pressure on the motor.

This invention is distinctive over prior patents, including the above named patent, by providing a relatively simple frame journalling a shaft having a wire reel connected to one of its end portions and a belt pulley at its other end driven by a belt entrained around a motor pivotally supported for movement toward and away from the frame with the entire unit mounted on a telescopically adjustable base to be supported in mobile fashion by a pickup truck or stationary earth driven standards.

SUMMARY OF THE INVENTION

An inverted generally U-shaped base, having an elongated telescopically adjustable bight portion, is provided with relatively short legs which are telescopically inserted into opposing stake pockets at the tailgate end portion of a pickup truck. Alternatively, the base legs may be inserted into the upper end portion of a pair of pipes, or the like, driven into or supported by the surface of the earth. Intermediate its ends, the base supports an upright frame having bearings journalling a shaft projecting horizontally beyond the respective bearings and connected at one end portion with a driven belt pulley. The other end of the shaft is releasably connected coaxially with a wire reel rotatable with the shaft. A pair of arms, pivotally connected with the frame, project laterally of the base and frame for supporting a motor with its drive shaft parallel with the frame shaft. A drive pulley on the motor drive shaft drives a belt entrained around the driven pulley. A control handle, connected with one of the motor support arms, projects rearwardly of the pickup and is arcuately curved upwardly to form a hand grip. An electrical circuit, including a push button switch mounted on the upstanding end of the handle, connects the vehicle battery positive terminal to the motor through a solenoid for starting and stopping the motor.

The principal object of this invention is to provide a relatively simple and easily constructed portable wire reel device having a telescopically adjustable base capable of fitting in the stake pockets of a conventional pickup truck bed for winding up or paying out electric fence wire.

BRIEF DESCRIPTION OF THE DRAWINGS

FIG. 1 is a fragmentary side elevational view of the device mounted on the rearward end portion of a pickup truck bed;

FIG. 2 is a fragmentary left side elevational view, to a larger scale, of the device as shown by FIG. 1 when supported by standards driven into the surface of the earth;

FIG. 3 is a fragmentary top view of FIG. 2;

FIG. 4 is a fragmentary left side elevational view of FIG. 3; and,

FIG. 5 is a fragmentary vertical cross sectional view taken substantially along the line 5—5 of FIG. 3.

DESCRIPTION OF THE PREFERRED EMBODIMENT

Like characters of reference designate like parts in those figures of the drawings in which they occur.

In the drawings:

The reference numeral 10 indicates the device having a base 12 telescopically received by upwardly open stake pockets 14 conventionally formed in opposing sides of the rearward end portion of the pickup truck bed, indicated generally at 16. The base 12 is preferably formed from tubular material, square in transverse section, and is inverted U-shaped in general configuration having two-part telescopically adjustable length elongated bight portions 18 and 20 and relatively short legs 22. The base leg members 22 are freely received by the upwardly open sockets formed by the pickup bed stake pockets 14 or alternatively may be inserted into the sockets formed by the upper end portion of a pair of standards, such as pipes 24, driven into or supported by the surface of the earth, indicated at 26.

The device 10 further includes a frame 28 comprising a pair of angle iron members 30, or the like, arranged in vertical spaced-apart relation in the plane of the base 12 and connected at their depending ends with the base bight member 18. A pair of bearings 32, secured to the upper end portions of the members 30, horizontally journal a shaft 34 projecting, at its respective ends, beyond the bearings. One end portion of the shaft 34 is secured to a driven V-belt pulley 36 of selected size. The other end portion of the shaft 34 is coaxially connected with a spindle 38, preferably square in transverse section, for coaxially supporting a wire reel 40.

The reel 40 comprises a pair of planar flanges 42 and 44 interconnected by a hub 46. The hub 46 may be provided with an axial aperture cooperatively surrounding the spindle 38, or, as illustrated by FIG. 5, may be provided with an inner sleeve-like hub 48 connected with the outer hub 46 by spokes 50. The reel 40 is releasably maintained on the spindle 38 by a click pin 52 inserted into a suitable aperture in the end portion of the spindle projecting beyond the reel flange 42.

A pair of arms 54 and 56 are pivotally connected at one end with the depending end portion of the frame members 30 for vertical pivoting movement about a horizontal axis. The arms project laterally of the base 12 and are maintained in parallel relation by a cross brace 58. The other end portion of the arms are secured to a V-shaped motor platform 60 extending transversely therebetween for receiving and supporting an electric motor 62 with its drive shaft 64 parallel with the shaft 34. Band clamps 66, connected with the motor platform 60, rigidly secures the motor 62. A V-belt drive pulley 68, of substantially smaller diameter than the driven pulley 36, is mounted on the motor drive shaft 64 and receives a V-belt 70 entrained around both pulleys.

An elongated tubular handle 72 is connected at one end to the motor support arm 56 opposite its connection with the frame 28 to form an extension thereof which is turned arcuately upward to form an upright handle grip portion 74 in spaced relation with respect to the motor 62.

An electrical circuit 76 operatively connects the motor 62 with the vehicle battery, not shown, by a wire 78 or with an auxiliary battery B when the device is mounted on the standards 24. A solenoid S, supported by the motor or one of its mounting members, is preferably interposed in the battery to motor wiring and a push button switch 80 is mounted on the upstanding end portion of the handle grip 74 for energizing the motor when the push button switch is manually depressed.

OPERATION

With the device 10 assembled, as described hereinbove, and selectively supported by a pickup truck or standards the adjacent end portion of the electric fence wire, indicated at 82, is secured to the flange or hub of the reel 40 in a conventional manner. Manually depressing the push button 80 energizes the motor for angularly rotating the reel 40 in a winding up action of the wire 82 on the hub 46. Gravitational attraction for the mass of the motor normally maintains sufficient tension on the belt 70 to rotate the reel. The angular rate of rotation of the wire reel may be decreased by manually lifting the motor by the handle 72 to generate a slip-clutch action on the drive pulley 68 relative to the belt. The belt 70 also functions as a slip-clutch, when reeling in the wire 82, in the event the wire becomes caught on a fixed object. Releasing the button 80 de-energizes the motor.

When the reel 40 is full it may be removed and replaced with another reel by removing the click pin 52. The wire 82 may be payed out from the reel 40 when stringing the wire to form a fence wherein the motor 62 acts as a brake against spin of the reel. By manually lifting the motor by the handle 72 and removing the belt 70 the reel may be permitted to rotate freely with the shaft and spindle.

Obviously the invention is susceptible to changes or alterations without defeating its practicabilty. Therefore, I do not wish to be confined to the preferred embodiment shown in the drawings and described herein.

I claim:

1. A wire reeling device, comprising:

an inverted substantially U-shaped base having a horizontal elongated telescopically adjustable bight portion and having relatively short depending legs;

base support means having upwardly open sockets for receiving said base legs;

upstanding frame means mounted on said bight portion;

elongated shaft means journalled by said frame means parallel with the longitudinal axis of said bight portion;

a wire reel means releasably secured to said shaft means;

an electric motor having a drive shaft;

means connecting said motor with said frame for vertical pivoting movement about a horizontal axis toward and away from said shaft means; and, belt and pulley means drivably connecting said motor with said shaft means.

2. The wire reeling device according to claim 1 in which said frame means comprises a pair of spaced-apart members disposed in the plane of said base; and, a pair of bearings respectively secured to said frame members.

3. The wire reeling device according to claim 2 in which said shaft means comprises:

a cylindrical shaft journalled by and projecting, at its respective end portions, beyond said bearings; and, a spindle, rectangular in transverse section, coaxially secured at one end to said cylindrical shaft.

4. The wire reeling device according to claim 3 in which said motor connecting means includes:

a pair of arms pivotally connected at one end portion with said frame members and projecting laterally of said base; and, a motor platform transversely connected between the other end portions of said arms.

5. The wire reeling device according to claim 4 in which said wire reel means comprises:

a spool-like reel having planar flanges axially interconnected by a hub, said hub having a central rectangular aperture.

6. The wire reeling device according to claim 5 and further including:

a handle rigidly secured at one end with one said arm and projecting at its other end portion, beyond said motor opposite said frame.

7. The wire reeling device according to claim 6 and further including:

a source of electrical energy; and, wiring including a switch supported by said handle operatively connecting the source of electrical energy with said motor.

8. The wire reeling device according to claim 4 or 7 in which said base support means includes:

a pair of tubular members capable of being vertically driven into the surface of the earth in parallel spaced-apart relation.

* * * * *